US006464083B1

(12) United States Patent
Harrison et al.

(10) Patent No.: US 6,464,083 B1
(45) Date of Patent: Oct. 15, 2002

(54) METHOD AND APPARATUS FOR SELECTIVELY CAPTURING FERROUS DEBRIS FROM A FLOOR

(75) Inventors: Paul S. Harrison, Pittsford; David A. D'Orazio, Penfield; Robert H. Muraco, Amherst, all of NY (US)

(73) Assignee: HM Cross & Sons, Rochester, NY (US)

( * ) Notice: Subject to any disclaimer, the term of this patent is extended or adjusted under 35 U.S.C. 154(b) by 0 days.

(21) Appl. No.: 09/416,567

(22) Filed: Oct. 12, 1999

(51) Int. Cl.[7] ..... B03G 1/00; E01H 1/00

(52) U.S. Cl. ..... 209/213; 209/214; 209/215; 15/340.1

(58) Field of Search ..... 209/215, 213, 209/214, 223.1, 636, 228; 15/340.1, 340.3, 340.4, 405, 345, 346

(56) References Cited

U.S. PATENT DOCUMENTS 2,426,795 A * 9/1947 Sjostrom ..... 209/215
2,629,495 A * 2/1953 Smale ..... 209/215
3,172,143 A * 3/1965 Yucis et al. ..... 15/340.1
3,401,365 A * 9/1968 Grader et al. ..... 335/289
3,605,170 A * 9/1971 Hank et al. ..... 15/346
4,407,038 A * 10/1983 Haase ..... 15/105
4,593,766 A * 6/1986 Gossard ..... 171/63
5,005,253 A * 4/1991 Noelle et al. ..... 15/346
5,549,207 A * 8/1996 Busico et al. ..... 209/614

* cited by examiner

*Primary Examiner*—Donald P. Walsh
*Assistant Examiner*—Joseph Rodriguez
(74) *Attorney, Agent, or Firm*—Brian B. Shaw, Esq.; Stephen B. Salai, Esq.; Harter, Secrest & Emery LLP

(57) ABSTRACT

An apparatus for collecting, transporting and releasing ferrous debris from a floor is disclosed. The apparatus includes a magnet movable between a lowered and a raised position to provide a sufficient magnetic field intensity to capture debris from the floor in the lowered position and to permit gravity induced separation of the debris in the raised position. The magnet may be a permanent magnet or an electromagnet.

20 Claims, 4 Drawing Sheets

METHOD AND APPARATUS FOR SELECTIVELY CAPTURING FERROUS DEBRIS FROM A FLOOR

FIELD OF THE INVENTION

The present invention relates to equipment for removing scrap from floors, and more particularly to a method and apparatus for the removal of ferrous debris from a floor, wherein the floor includes a track.

BACKGROUND OF THE INVENTION

Manufacturing facilities, machine shops and other metal forming, metal stamping and processing facilities generate significant quantities of scrap metal. The scrap metal often falls to the floor as debris in the form of fragments, slugs and shards. As the debris accumulates on the floor, the floor must be periodically cleaned. The frequency of cleaning is primarily determined by the ability or opportunity for the debris to negatively impact operation (i.e. cause downtime) of the production line, and/or damage the facility or equipment. In addition, the rate at which the scrap is produced, the area over which the scrap is distributed, the traffic in the area of the accumulated scrap as well as worker safety are considered in cleaning frequency.

The problem of accumulating debris is particularly challenging in those facilities that have relatively high production volumes or operate on large metal pieces which require heavy duty transport systems within the facility. These transport systems may includes tracks or guides which may be embedded within the floor. The tracks facilitate the movement of production subsystems, such as die carts, or other systems which transport materials and products about the facility. Typically, these tracks are in areas which must also be traversed by other types of vehicles and pedestrians. Therefore, the tracks are often embedded in the floor. The tracks usually form a gap between the track and the adjacent floor or include a recess to accommodate a wheel flange. Scrap which falls in the gaps or recess tends to accumulate, and if left unchecked, may become a hazard or induce misalignment of the subsystems.

Therefore, a need exists for a system of readily cleaning debris from floors. The need further exists for removing ferrous debris from those facilities that employ embedded or recessed guidance systems wherein the debris may be readily captured, moved and deposited in a desired location.

SUMMARY OF THE INVENTION

The present invention is designed to facilitate the removal of debris from a floor, and particularly to the removal of ferrous debris from floors, and more particularly, the removal of ferrous debris from a floor having an embedded or recessed guidance system including a ferrous track.

Generally, the invention encompasses a magnet that is selectively positioned with respect to the floor to capture magnetically attractable debris, wherein the magnet may be translated with respect to the floor. The invention is configured to permit subsequent movement of the magnet to allow gravity induced release of the captured debris at a desired location.

In a specific embodiment, a non-magnetic shield is attached to a vehicle, wherein a permanent magnet is moveable between a lowered position adjacent the shield and a raised position spaced from the shield. The shield and the magnet are configured such that in the lowered position, the magnet captures the ferrous debris beneath the shield and in the raised position the ferrous debris is allowed to separate from the shield under the influence of gravity. By this construction, the present invention allows the selective capture of the ferrous debris, transportation of the debris and selective release of the debris.

The shield may have any of a variety of configurations such as a plate, a channel or a box. A preferred configuration of the shield is a box sized to substantially enclose the magnet in the lowered position and the raised position, so as to protect the magnet from the operating environment.

The invention also contemplates a blower such as an air knife to dislodge and move the debris. Particularly, the blower is selected to move debris away from the ferrous tracks and any associated gaps into an area where the debris can be readily attracted by the magnet without magnetizing the tracks.

DETAILED DESCRIPTION OF THE PREFERRED EMBODIMENTS

Figure 1:
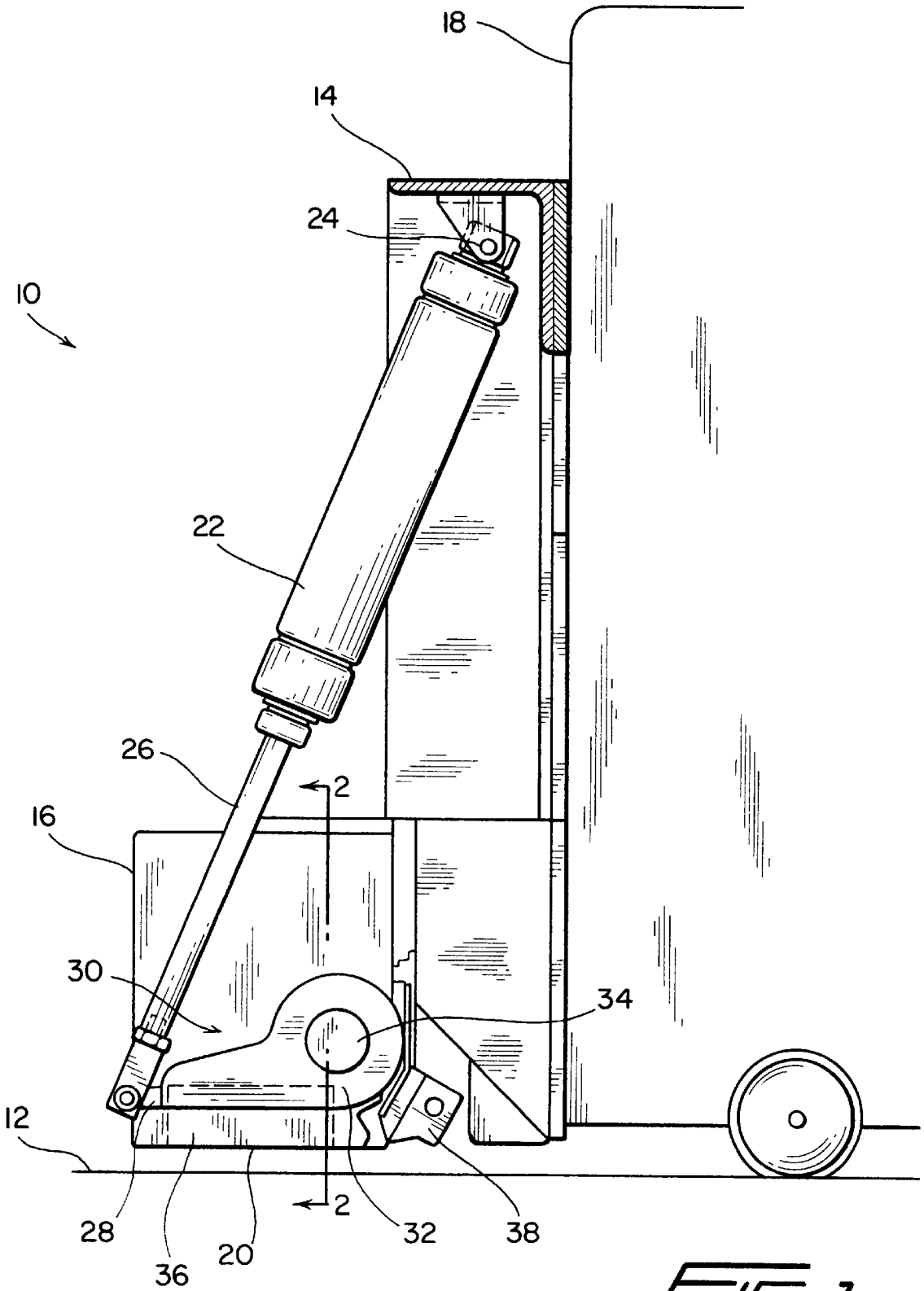
FIG. 1 is a side view of a magnetic debris collector with a magnet in a lowered position.

Referring to FIG. 1, a collector 10 for gathering magnetic debris from a floor 12 is shown. The collector 10 may be releasably or fixedly connected to a cart 18 or housing for translation with respect to the floor 12. For purposes of description, the collector 10 is shown as mounted on the cart 18. The debris may include any type of ferrous by-product such as shavings, scraps, shards or fragments. The ferrous debris is magnetizable, and in the present invention is contemplated to be magnetized by the collector 10. Thus, the debris becomes attracted to a magnet. However, it is understood the ferrous debris includes materials that may be magnetizable by the collector 10 so as to be captured, as well as those materials that may be magnetized prior to exposure to the collector.

In one operating environment, the collector 10 is employed with the floor 12, wherein the floor includes an industrial track 44 (FIGS. 2, 4 and 5) recessed into the floor. The track 44 may include a pair of rails for engaging flanged wheels of the cart 18. As shown in FIG. 2*a*, the track 44 may be constructed to include the gap. In view of cost considerations, the tracks 44 are usually formed of a ferrous material. That is, upon sufficient exposure to a sufficient magnetic field, the tracks 44 become magnetized. Once magnetized, the tracks 44 would retain the ferrous debris and require labor intensive and time consuming cleaning procedures. The floor 12 is preferably non-magnetic such as brass, wood block, stainless steel or concrete.

Figure 5:
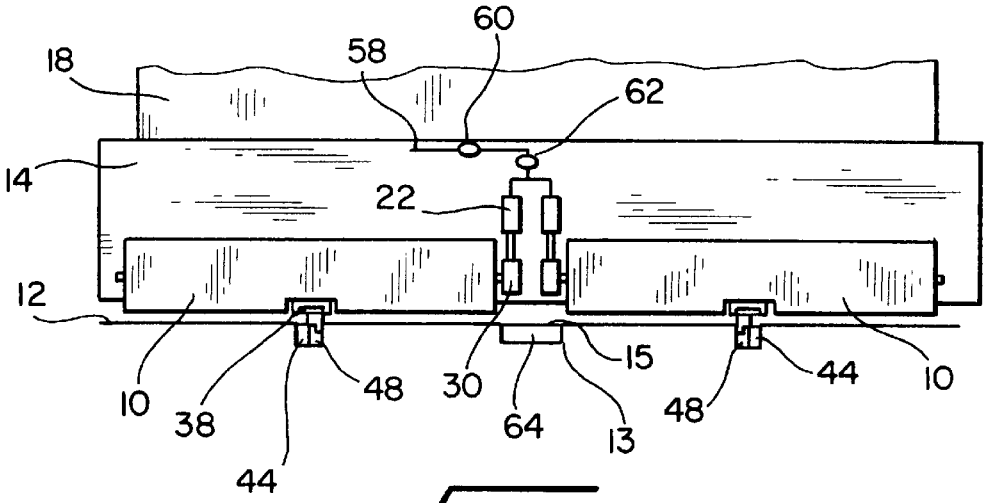
FIG. 5 is a front elevational view of magnetic debris collector mounted on a vehicle.

The cart 18 may be any of a variety of devices such as transport carts or die bolsters. The cart 18 may be remotely powered and controlled via cable connections, wire-less communications or a combination of both. Typically, the cable connections are accomplished through the use of a cable-way. As shown in FIG. 5, the floor 12 may also include an elongate recess 13 into which the flexible cable way is retained. A door 15 covers the recess 13 to permit the selective egress and ingress of the cable-way in the recess. The recess 13 is located intermediate a pair of tracks 44.

As shown in FIG. 1, the collector 10 includes a frame 14, an actuating mechanism 17, a shield 16, and a magnet 36. The frame 14 is connected to the cart 18 to orient the remaining components with respect to the floor 12. The frame 14 may be fixedly or releasably connected to the cart 18, as dictated by the intended operating parameters. As the cart 18 travels along the track 44, the frame 14 causes the collector 10 to travel with the cart.

The shield 16 is a non-ferrous material and forms a barrier between the magnet 36 and the floor 12. The shield 16 may have any of a variety of configurations such as plates, cases, troughs, channels or boxes. In one construction, the shield 16 is configured as an elongate box having a rectangular cross section. The box configuration of the shield 16 is sized to enclose the magnets 36 independent of the position of the magnet. The box 16 thus protects the magnet 36 from the operating environment as well as inadvertent contact with a user. The box 16 has at its base an exterior collection surface 20, which is exposed to the floor 12. The spacing between the collection surface 20 and the floor 12 is at least partially dictated by the anticipated size of the debris, the amount or density of the debris over the surface area of the floor, the length of the collecting path, the strength of the magnet and the resulting magnetic field intensity exposed to the debris.

Figure 3:
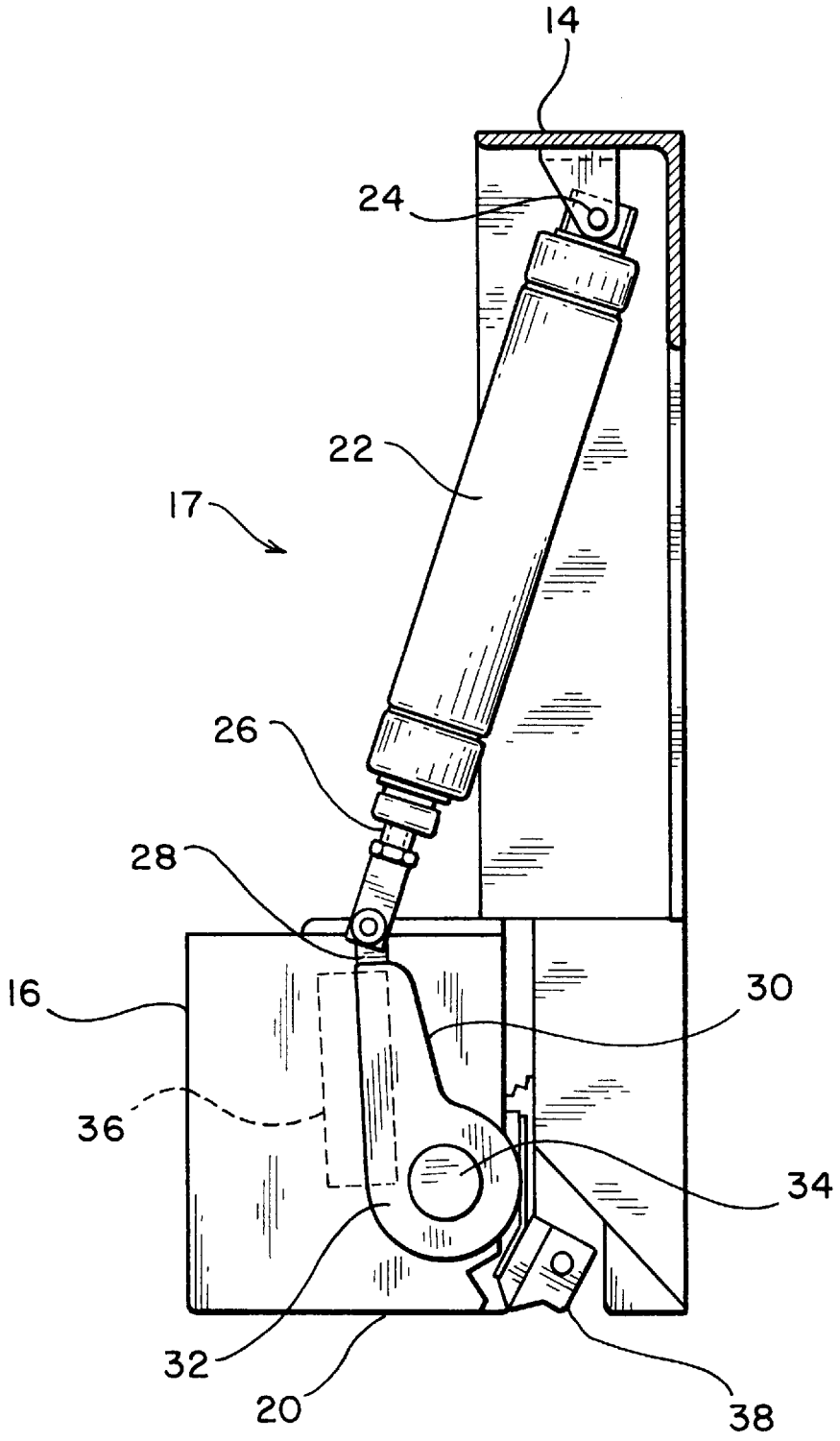
FIG. 3 is a side view of the magnetic debris collector with the magnet in a raised position.

The actuating mechanism 17 interconnects the magnet 36 and the frame 14 to locate the magnet relative to the shield 16. The actuating mechanism 17 moves the magnet between a lowered position (FIG. 1) and a raised position (FIG. 3).

The actuating mechanism 17 includes a number of pistons 22 and a throw arm 30. The pistons 22 have at one end a pivotal attachment 24 to the frame 14, and having at the other end a piston rod 26 connected to a throw arm 30. Each throw arm 30 is pivotally connected to the frame 14 at a location spaced from the connection of the piston 22 as show in FIG. 5. In a first configuration, the throw arm 30 is mounted on a shaft 34 which is rotatable about its longitudinal axis. Thus, the throw arm 30 pivots about the axis of the shaft 34.

In the preferred embodiment, the pistons 22 are pneumatic, and are operated from a common control, which has a pneumatic line 58, a pressure regulator 60 and a solenoid valve 62 to actuate pistons 22. The pistons 22 are most conveniently located close together on the inboard sides of collectors 10 and 10', so that collectors 10 and 10' have a "mirror image" relationship. It is understood alternative mechanisms may be employed for actuating the pistons 22, such as hydraulic, solenoid, electromechanical or electrical.

The magnet 36 is disposed within the box configuration of the shield 16. As shown in FIG. 1, the magnet 36 is in the lowered position adjacent the shield 16. The actuating mechanism 17 may be adjusted so that the magnet 36 rests upon the box in the lowered position. The location of the magnet 36 relative to the shield 16 in the lowered position is at least partially determined by the size of the magnet, the anticipated amount of the debris to be retained by the magnet, the strength of the magnet and the size of the debris.

Figure 2:
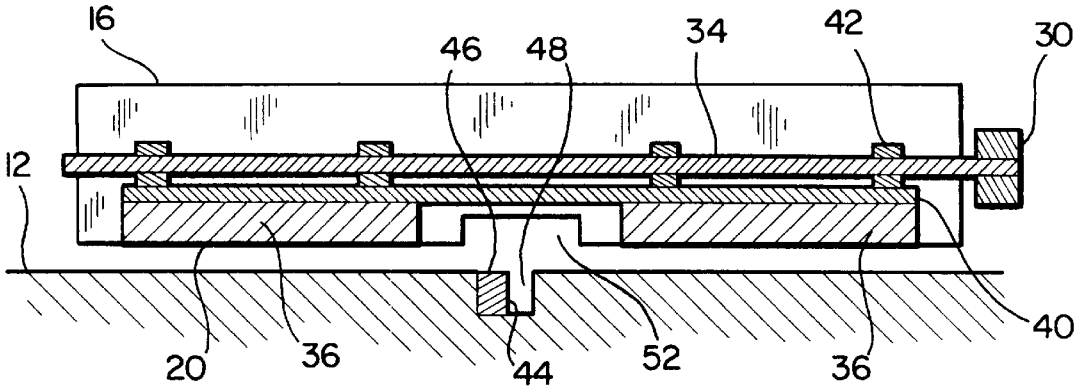
FIG. 2 is a schematic cross-section front elevational view of the collector taken along line 2—2 of FIG. 1.
Figure 2A:
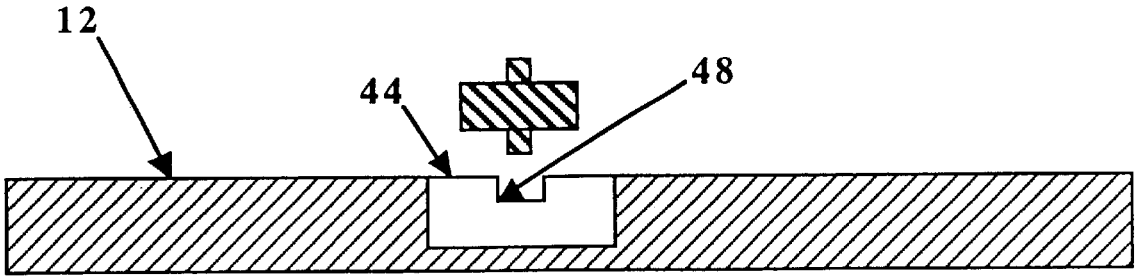
FIG. 2*a* is a cross sectional view of an alternative construction of the track.

Referring to FIG. 2, the magnet 36 is affixed to a holder 40 which is fixedly held by brackets 42 to the shaft 34. Also shown in FIG. 2, the track 44 is embedded in the floor 12, the track having a traction surface 46 flush with floor 12, and having alongside or in the track there is a gap 48 sufficiently wide and deep to accommodate the flange of a railway type wheel. The collector 10 may include a second magnet 36' colinear with magnet 36. The use of a second magnet 36' is primarily dictated by the intended operating parameters of the collector 10. The present invention includes the second magnet 36' fixedly held on shaft 34 in the same way as the first magnet 36, so that the two magnets can be moved together, always remaining colinear.

The magnets 36, 36' are located to avoid magnetizing the track 44. The magnets 36 and 36' are spaced apart such that their closest ends do not travel above the track 44. That is, neither of the magnets 36 and 36' straddles track 44, but each lies entirely to one side of the track. The collector 10 is configured so that the nearest approach of the magnets 36 to the tracks 44 does not magnetize the tracks. That is, independent of the position of the magnets 36 in the collector 10, the magnetic field to which the tracks 44 are exposed is not sufficient to magnetize the tracks. Therefore, the collector 10 will not induce sufficient magnetism of the tracks 44 to retain the debris. In the lowered position, the magnets 36 thus define a capture volume having a sufficient magnetic field intensity to magnetize and capture ferrous debris within the capture volume. As the tracks 44 may be magnetizable, it is preferred the capture volume be spaced from the tracks a sufficient distance to preclude magnetizing the tracks.

It will also be noted that the shield 16 may include a recess 52 straddling the track 44 and the gap 48.

Referring to FIG. 3, the collector 10 is shown in the raised position with the magnet 36 elevated to the raised position by rotating the shaft 34 about its longitudinal axis. The throw arms 30, the shaft 34 and the holder 40 are configured to sufficiently space the magnet 36 from the shield 16 in the raised position so that the debris is not magnetically retained against the shield. That is, the magnet 36 is sufficiently spaced from the collection surface 20, so that the magnetic field intensity is sufficiently reduced, so that the debris separates from the collector 10. In one configuration of the invention, the shaft 34 is located with respect to the frame 14 and the shield 16 so that the magnet 36 (36') swings in an arc when moved from the lowered position to the raised position. As a result, the magnet 36 in its raised position is sufficiently far from collection surface 20 to substantially preclude the magnetic retention of the debris against the shield 16.

Figure 4:
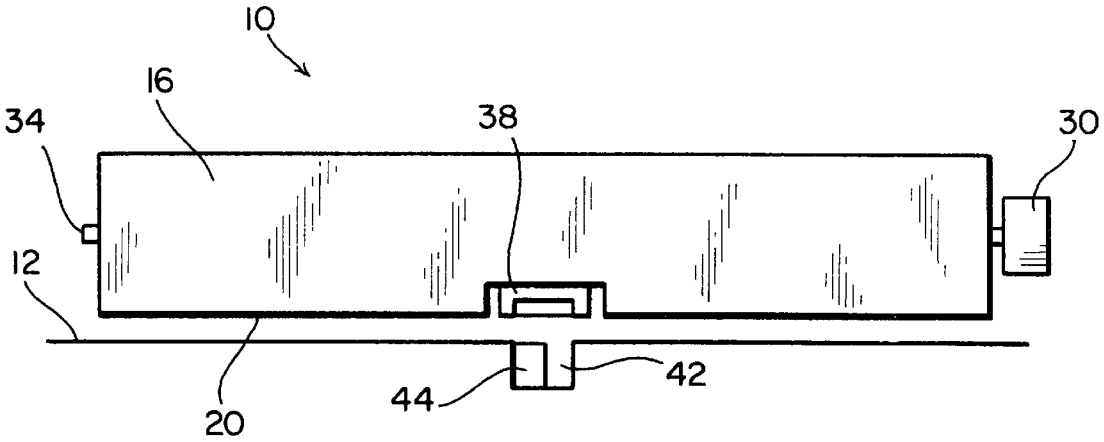
FIG. 4 is a front elevational view of the magnetic debris collector.

A blower 38 as shown in FIG. 4, is positioned in recess 52 above the track 44 and the gap 48, such that a fluid can be directed down across the tracks 44 and the gap 48. The blower 38 may be an air knife having a nozzle for forming a jet and a connector for connection to a pressurized fluid supply. It is anticipated the blower 38 will employ air as the fluid directed on to the floor and into the gap 48, and the fluid supply will be an air compressor. The air compressor may be retained on the cart 18 or may be "factory" air from a pressurized source spaced from the cart. The air knife and a supporting pressurized air supply are selected to dislodge and move the debris from the area of the tracks 44 and the gap 48 toward the capture volume. The debris is moved to a location where the magnets 36 in the lowered position expose a sufficient magnetic field to the debris so that the debris is magnetized and captured by the collector 10, without magnetizing the tracks 44 to an extent sufficient to retain the debris on the tracks.

Thus, the collector 10 includes a first magnet 36 and a second magnet 36' disposed to either side of rail 44. Since conventional rail tracks have two rails, it is contemplated to have a second collector 10' mounted alongside collector 10 on vehicle 18, as shown in FIG. 5, wherein each collector is on an opposing side of the elongate recess 13 which extends between the tracks.

Although the collector 10 has been described in terms of a permanent magnet 36 that is movable between the lowered position and the raised position, it is contemplated the magnet may be fixed with respect to the shield 16. In this configuration, the fixed magnet is selectively energized to create a magnetic field. The magnet may be an electromagnet located adjacent the shield 16. While the shield 16 is employed to reduce wear of the magnet, it is also understood the collector may be constructed without the shield 16.

Operation

In operation, the cart 18 moves along the embedded track 44. The pistons 22 are actuated to move magnets 36 from the raised position to the lowered position, thereby creating a sufficiently large magnetic field intensity beneath collection surface 20 of the shield 16 to attract and retain the debris. In addition, the air blowers 38 may be actuated to move debris from the track 44, dislodge debris from the gap 48 and move the dislodged debris to the capture volume. As the cart 18 moves along track 44, the air blowers 38 displace the debris from gaps 48 as well as direct the debris from the track to areas of high magnetic field intensity beneath the shield 16 where the debris is magnetized and retained. The air blowers 38 also direct debris towards the high magnetic field intensity beneath the shield 16 from the central portion 64 of floor 12 between tracks 44 which is not directly covered by either of the individual collectors 10 and 10'. After a desired length of the track 44 has been cleared of debris, flow through the air knife may be terminated and the cart 18 proceeds to a dumping area, where it is halted with the collection surface 20 of the shield 16 appropriately positioned for dumping the accumulated debris. Pistons 22 are actuated to move the magnets 36, 36' into the raised position, thereby redirecting the magnetic fields to sufficiently reduce the magnetic field intensity at the collection surface to allow gravity to urge the debris from the shield 16. Alternatively, if an actuatable magnet such as an electromagnet is employed, the cart 18 is located at the positioning for dumping the debris and the magnet is de-energized, thereby causing the debris to fall to the floor 12.

Control of the collector 10 may be accomplished by a variety of mechanisms. It is contemplated that a single controller such as a solenoid may be used to provide a single action initiation of air flow through the blower (air knife) and location of the magnets 36 in the lowered position. Similarly, a single action would terminate air flow through the air knife and raise the magnets 36 to the raised position, thereby releasing the debris from the collector 10. Alternatively, the fluid flow through the air knife and the actuation of the magnets 36 may be separately controlled. For example, a first control solenoid initiates or terminates flow through the air knife and a second control solenoid initiates raising (deactivating) or lowering (activating) of the magnets 36. Thus, the debris could be moved from the tracks 44 by the blower independent of a magnetizing field from the magnets 36.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

We claim:

1. An apparatus for removing ferrous debris from a floor having a ferrous track; comprising:

(a) a non-magnetic collection surface spaced from the floor a sufficient distance to permit the debris to be located therebetween;

(b) a magnet disposed above the collection surface to create a magnetic field intensity at the collection surface, the magnet movable between a raised position and a lowered position to create a magnetic field intensity in the lowered position to attract the debris from the floor to the collection surface and the magnet being spaced from the collection surface in the raised position to allow the debris to be separated from the collection surface by a force of gravity; and (c) a blower for directing at least a portion of a fluid stream toward the track, the magnet selected so that in the lowered position the magnet is insufficient to magnetize the track, whereby debris subjected to the blower will not be magnetically retained by the track and will dislodge from the track such that a substantial amount of the debris is removed from the track.

2. The apparatus of claim 1, wherein the collection surface is a non-magnetic shield.

3. The apparatus of claim 1, wherein the collection surface is a portion of a box.

4. The apparatus of claim 1, wherein the magnet is a permanent magnet.

5. The apparatus of claim 1, further comprising a piston connected to the magnet to move the magnet between the raised position and the lowered position.

6. The apparatus of claim 1, wherein the blower is an air knife.

7. The apparatus of claim 1, further comprising an actuating mechanism connected to the magnet to move the magnet between the raised position and the lowered position.

8. The apparatus of claim 1, wherein the collection surface is a portion of a box sized to enclose the magnet.

9. The apparatus of claim 1, wherein the magnet defines a capture volume in the lowered position and the blower moves the debris to the capture volume.

10. A device for removing ferrous debris from adjacent a magnetizable track embedded in a floor, comprising:

(a) a non-magnetic shield having a collection surface proximate with the floor;

(b) a blower connected relative to the collection surface to move the debris from a magnetized attraction with the track; and (c) a magnet spaced from the collection surface, the magnet movable between a lowered position to retain ferrous debris against the collection surface and a raised position to permit gravity induced separation of the debris from the collection surface, the magnet configured so that in the lowered position the magnet is insufficient to magnetize the track, whereby debris subjected to the blower will not be magnetically retained by the track and will dislodge from the track such that a substantial amount of the debris is removed from the track.

11. The device of claim 10, wherein the shield is a stainless steel box.

12. The device of claim 10, wherein the magnet is connected to an actuating mechanism for moving the magnet between the lowered position and the raised position.

13. An apparatus for selectively capturing ferrous debris from a floor having a magnetizable track, comprising:

(a) a magnetic field generator selectively actuatable to create a magnetic field at the track to capture the debris from the track; and (b) a fluid stream generator configured to direct a fluid stream against the track to induce movement of debris from the track into the created magnetic field to capture the debris, the magnet field generator and the fluid stream generator selected so that the created magnetic field at the track is insufficient to magnetize the track, whereby debris subjected to the fluid stream generator will not be magnetically retained by the track and will dislodge from the track such that a substantial amount of the debris is removed from the track.

14. The apparatus of claim 13, wherein the magnetic field generator is an electromagnet.

15. The apparatus of claim 13, wherein the magnetic field generator is a permanent magnet moved between a first position adjacent the floor and a second position spaced from the floor.

16. The apparatus of claim 13, further comprising a non-magnetic shield intermediate the floor and the magnetic field generator.

17. The apparatus of claim 13, wherein the non-magnetic shield is an elongate box sized to at least partially enclose the magnetic field generator.

18. The apparatus of claim 13, wherein the created magnetic field is sufficient to magnetize the debris.

19. A method of collecting and translating ferrous debris relative to a floor having a ferrous track, comprising:

(a) locating a magnet sufficiently near a non magnetic shield to create a magnetic field to magnetically attract and retain the debris to the shield;

(b) impinging a fluid stream against a portion of the floor to move debris relative to the floor and separate magnetically attracted debris from the track to capture a portion of the moved and separated debris in the created magnetic field; and (c) moving the magnet a sufficient distance from the shield to allow gravity induced separation of the debris from the shield;

the magnet being configured to provide a magnetic field intensity insufficient to magnetize the track, whereby debris subjected to the fluid stream will not be magnetically retained by the track and will be dislodged from the track such that a substantial amount of debris is removed from the track.

20. A method for removing ferrous debris from a floor having a magnetizable track, comprising:

(a) moving a permanent magnet from a raised position to a lowered position relative to a non-magnetic shield;

(b) impinging a fluid stream against a portion of the floor to separate debris from a magnetic attraction to the track;

(c) retaining a portion of the moved debris in a magnetic field adjacent the shield; and (d) moving the magnet to a position spaced from the shield to induce separation of the debris from the shield.

* * * * *